US007893800B2

(12) United States Patent
Shimizu et al.

(10) Patent No.: US 7,893,800 B2
(45) Date of Patent: Feb. 22, 2011

(54) VEHICLE SWITCH

(75) Inventors: Masaru Shimizu, Kyoto (JP); Kiyotaka Sasanouchi, Osaka (JP); Hiroyuki Kosaka, Fukui (JP); Tsutomu Maeda, Osaka (JP)

(73) Assignee: Panasonic Corporation, Osaka (JP)

( * ) Notice: Subject to any disclaimer, the term of this patent is extended or adjusted under 35 U.S.C. 154(b) by 64 days.

(21) Appl. No.: 11/758,238

(22) Filed: Jun. 5, 2007

(65) Prior Publication Data

US 2007/0290642 A1 Dec. 20, 2007

(30) Foreign Application Priority Data

| | | |
|---|---|---|
| Jun. 6, 2006 | (JP) | 2006-156952 |
| Jul. 21, 2006 | (JP) | 2006-198959 |
| Sep. 12, 2006 | (JP) | 2006-246500 |
| Sep. 13, 2006 | (JP) | 2006-247721 |

(51) Int. Cl.
*H01H 9/00* (2006.01)

(52) U.S. Cl. ..... 335/205

(58) Field of Classification Search ..... 335/205; 338/32 R, 32 H

See application file for complete search history.

(56) References Cited

U.S. PATENT DOCUMENTS

| | | | | |
|---|---|---|---|---|
| 3,571,774 | A * | 3/1971 | Hubrich | 338/32 R |
| 3,668,596 | A * | 6/1972 | Hubrich | 338/32 R |
| 3,673,537 | A * | 6/1972 | Greger | 338/12 |
| 4,156,820 | A * | 5/1979 | Fukuda et al. | 307/116 |
| 5,714,728 | A | 2/1998 | Garneyer et al. | |
| 6,522,227 | B1 * | 2/2003 | Mody et al. | 335/14 |

FOREIGN PATENT DOCUMENTS

| | | | |
|---|---|---|---|
| CN | 1140360 | A | 1/1997 |
| JP | 2004-342437 | A | 12/2004 |
| JP | 2006-92777 | A | 4/2006 |

* cited by examiner

*Primary Examiner*—Ramon M Barrera
(74) *Attorney, Agent, or Firm*—RatnerPrestia

(57) ABSTRACT

A vehicle switch includes a magnet mounted to an operating unit accommodated in an external packaging such that the operating unit can move linearly. A magnetic detector is placed so as to receive different strength of the magnetism from the magnet in the two cases that the operating unit is at the upper limit position and at the lower limit position. A control circuit coupled to the magnetic detector opens and closes a switching device in response to strength of the detected magnetism.

6 Claims, 15 Drawing Sheets

VEHICLE SWITCH

BACKGROUND OF THE INVENTION

1. Field of the Invention

The present invention relates to switches to be used for turning on or off brake lights in response to stepping on the brake pedal of a vehicle.

2. Background Art

A push-type vehicle switch has been widely used for controlling brake lights in response to stepping on the brake pedal of a vehicle, to be more specific, the push switch turns on the brake lights when a driver steps on the brake pedal, and turns off the brake lights when the driver releases the pedal. Such a conventional vehicle switch is described hereinafter with reference to FIGS. 15 and 16.

FIG. 16 shows a sectional view of a conventional vehicle switch. This vehicle switch has housing 1 made of insulating resin, shaped like a box, and open upward; and operating unit 2 accommodated in housing 1 and movable vertically. Operating shaft 2A of operating unit 2 slides along cylinder 7A of cover 7 covering the opening at the top of housing 1. A plurality of fixed contacts 3 is provided to housing 1 and terminals 3A drawn from fixed contacts 3 protrude from the outer bottom of housing 1. Movable contacts 4 made of metal are urged by push-up spring 5 that is somewhat compressed and placed between the bottom of housing 1 and contacts 4, so that movable contacts 4 are brought into contact with fixed contacts 3 at the bottom of each one of fixed contacts 3. Fixed contacts 3 are thus coupled to each other electrically via movable contacts 4. Return spring 6 is somewhat compressed and placed between the lower face of operating unit 2 and the inner bottom of housing 1 for urging operating unit 2 upward. Operating shaft 2A, i.e. upper end of operating unit 2, protrudes upward from cylinder 7A provided at the center of cover 7. Conventional vehicle switch 10 is constructed as discussed above.

Vehicle switch 10 thus constructed is mounted to brake-pedal 11 on a side as laterally shown in FIG. 15, while operating shaft 2A of operating unit 2 is pressed by arm 11A. Terminals 3A of fixed contacts 3 protruding from the outer bottom of housing 1 are coupled to brake lights (not shown) and an electronic circuit via connector 12.

When brake pedal 11 is not stepped on, operating shaft 2A is pressed downward. This state is called "a steady state", hereinafter. In the steady state, operating shaft 2A compresses push-up spring 5 and return spring 6, so that movable contacts 4 move downward and leave fixed contacts 3. Thus, movable contacts 4 are not contact with each other electrically, and the brake lights are turned off.

The state in which brake pedal 11 is stepped on is illustrated with alternate long and two short dashes lines in FIG. 15. This state is called "an operated state", hereinafter. In the operated state, arm 11A leaves shaft 2A and the pressing force is removed, so that operating unit 2 moves upward due to resilient restoring force of return spring 6, and at the same time, movable contacts 4 are elastically urged against fixed contacts 3 by push-up spring 5 as shown in FIG. 16, so that fixed contacts 3 are electrically connected with each other for turning on the brake lights.

Vehicle switch 10 is generally used near brake pedal 11 of the vehicle, i.e. at a place having a lot of dampness, dust, gas or the like. Lubricating agent is generally applied to arm 11A pressing operating shaft 2A, so that the agent, gas, dust and dampness can enter into vehicle switch 10 and attach to fixed contacts 3 or movable contacts 4. As a result, carbide or silicon compound is formed on the surface of contacts 3 and 4, thereby inviting failure in electrical on/off of the contacts.

To prevent this failure, the switch is devised to be structured air-tightly in general. For example, operating shaft 2A and cylinder 7A are covered with a rubber cap, or space between housing 1 and cover 7 is sealed with adhesive or shielding member. This structure; however, requires a greater number of components and a longer time for assembly.

Prior art documents pertinent to the present invention are, e.g. Unexamined Japanese Patent Publication Nos. 2004-342437, and 2006-92777.

SUMMARY OF THE INVENTION

The present invention is a simply structured vehicle switch allowing an electrical switch-on or switch-off with reliability. The vehicle switch of the present invention includes a magnet mounted to an operating unit accommodated in an external packaging such that the operating unit can move linearly; and a magnetic detector sensible magnetism of the magnet, so that a switching device can be opened or closed in response to strength of the detected magnetism. The magnetic detector is placed so as to receive different strength of the magnetism in the two cases that the operating unit is at the upper limit position and at the lower limit position. Since the foregoing structure includes no fixed contacts or movable contacts, the switch can reduce troubles caused by the lubricating agent, gas, dust, and dampness around the switch. The vehicle switch in a simple structure thus ensures an electrical switch-on or switch-off.

DESCRIPTION OF THE PREFERRED EMBODIMENTS

Exemplary embodiments of the present invention are demonstrated hereinafter with reference to the accompanying drawings. In each embodiment, similar elements to those described in the prior embodiment have the same reference marks, and the descriptions thereof may be simplified.

First Exemplary Embodiment

Figure 1:
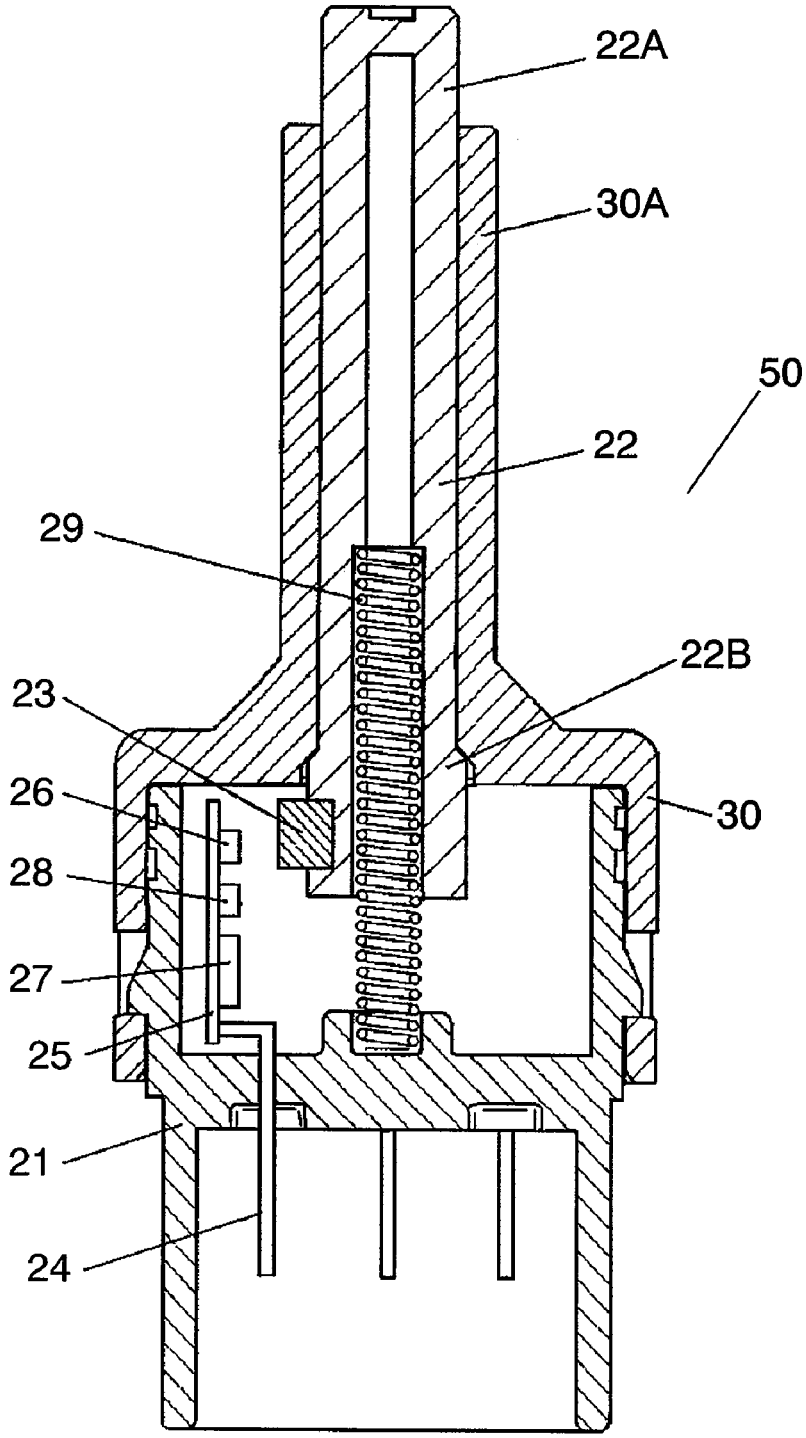
FIGS. 1 and 2 show sectional views of a vehicle switch in accordance with a first exemplary embodiment of the present invention.
Figure 2:
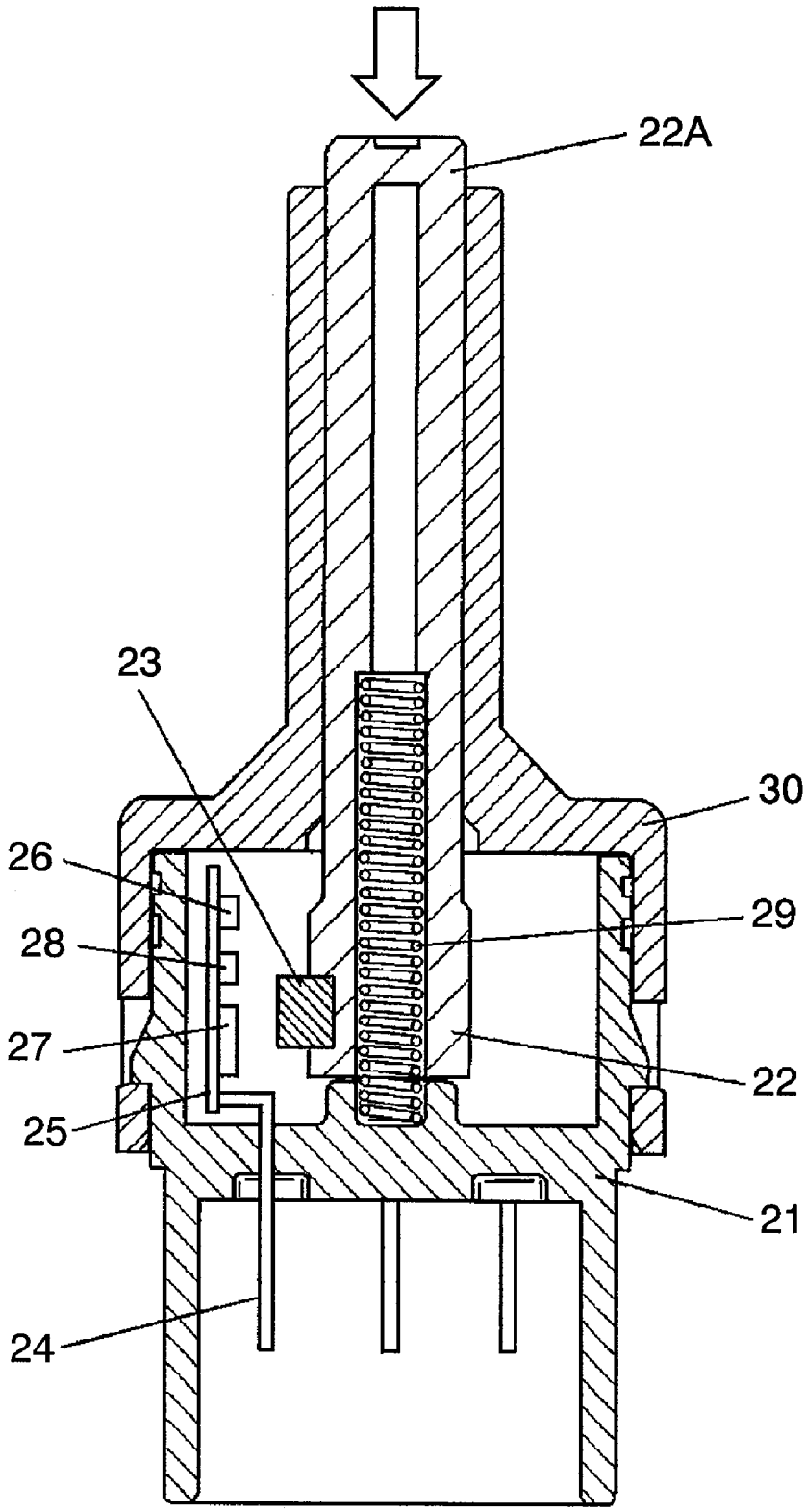
Figure 3:
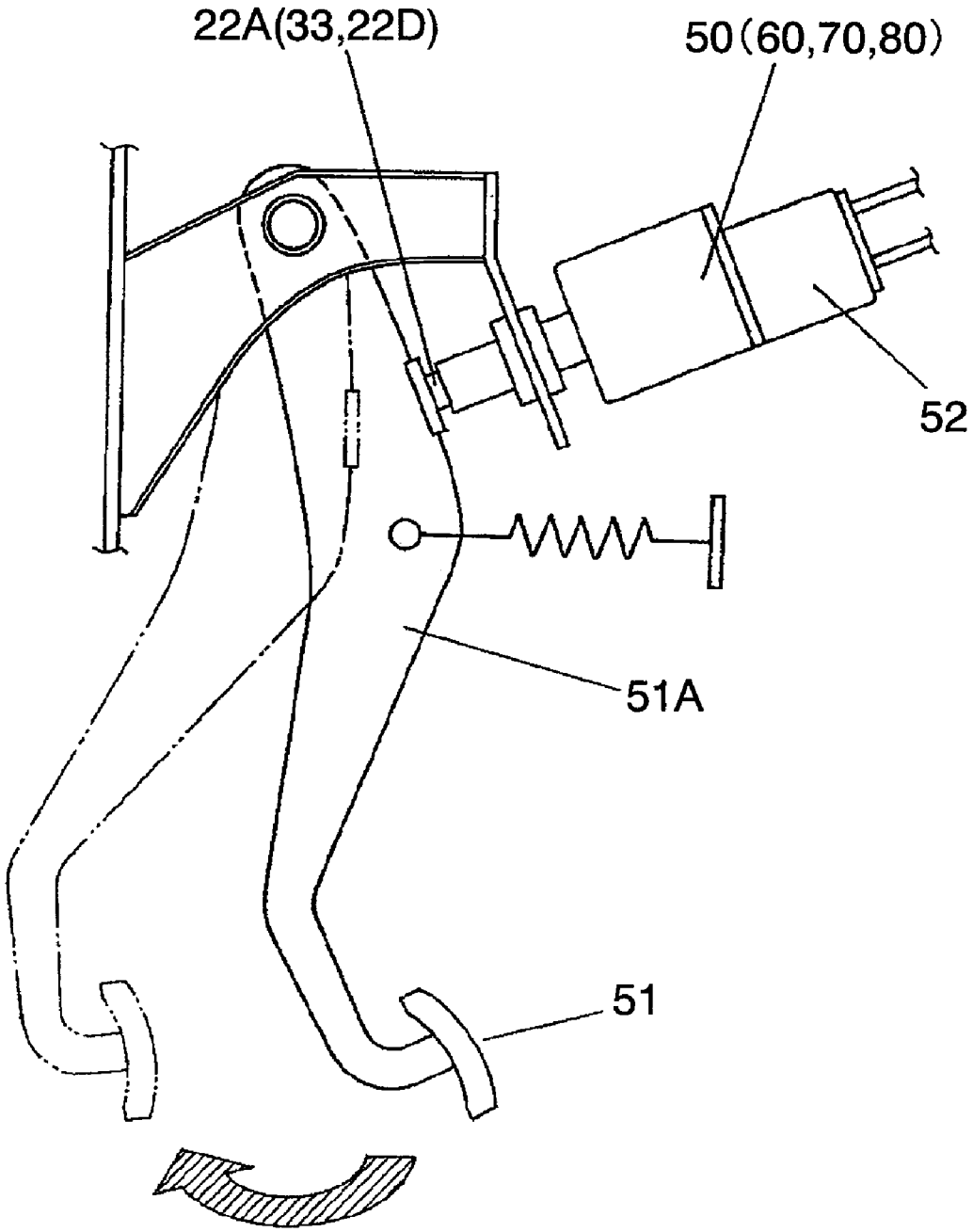
FIG. 3 shows a lateral view of brake employing one of vehicle switches in accordance with exemplary embodiments of the present invention.

FIGS. 1 and 2 show sectional views of a vehicle switch in accordance with the first exemplary embodiment of the present invention. FIG. 1 shows an operated state and FIG. 2 shows a steady state thereof. FIG. 3 shows a lateral view of brake employing the vehicle switch shown in FIG. 1. Housing 21 and cover 30 form the external packaging of vehicle switch 50. Housing 21 is box-shaped having an opening at the top thereof, and is made of insulating resin, e.g. polybutylene terephthalate (PBT) or acrylonitrile-butadien-styrene (ABS). Cover 30 covers the opening at the top of housing 21. Substantially columnar operating unit 22 made of insulating resin can move upward and downward in the external packaging made of housing 21 and cover 30 along cylinder 30A. That is to say, operating unit 22 is accommodated in the external packaging so as to be movable linearly.

Magnet 23 is attached to a lower lateral face of operating unit 22. Terminals 24 made of metal such as copper alloy protrude downward from the outer bottom of housing 21, and work as an electrical coupler to connector 52. Wiring board 25 is placed on the left sidewall of housing 21. The upper ends of terminals 24 are coupled to the wired pattern of wiring board 25 with soldering or the like. Wiring board 25 includes control circuit 28 and magnetic detector 26 of Hall-element on its face confronting magnet 23.

Figure 4:
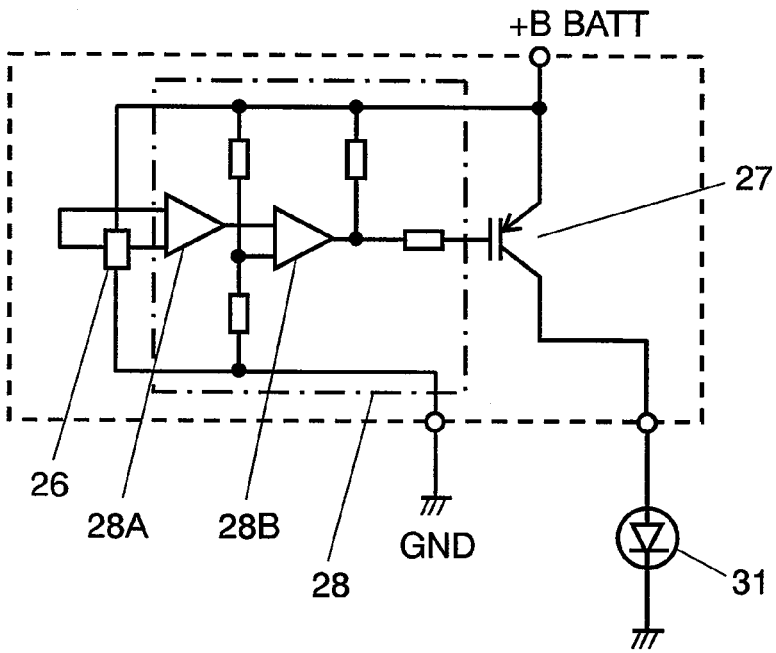
FIG. 4 shows an electrical circuit diagram including a control circuit for controlling the vehicle switch in accordance with the first exemplary embodiment of the present invention.

FIG. 4 shows a diagram of an electrical circuit including control circuit 28. Control circuit 28 is shown a portion surrounded by the alternate long and short dash line, and is formed of differential amplifier 28A formed of FET, voltage detector 28B, resistors, and the like. Control circuit 28 is coupled to magnetic detector 26 and switching device 27.

Return spring 29 is compressed and placed between the bottom of operating unit 22 and the inner bottom of housing 21. As shown in FIG. 1, while no external force is applied to operating unit 22 in the operating state, return spring 29 pushes operating unit 22 upward. In other words, return spring 29 pushes operating unit 22 in a direction away from the inner bottom of housing 21. Stopper 22B formed at the lower portion of operating unit 22 hits the underside of cover 30 for restricting operating unit 22 to the upper limit position.

Vehicle switch 50 thus constructed is generally mounted in front of brake-pedal 51 in a state that operating shaft 22A is pressed by arm 51A as shown in FIG. 3. Terminals 24 protruding from the outer bottom of housing 21 are coupled to brake light 31 and the electronic circuit of the vehicle shown in FIG. 4 via connector 52. To be more specific, while brake pedal 51 is not stepped on, operating unit 22 receives the force along the arrow mark shown in the upper side shown in FIG. 2. When operating unit 22 is pressed downward by a predetermined press-in length, e.g. 6 mm, it compresses return spring 29 until the bottom of operating unit 22 reaches the inner bottom face of housing 21. This state presents the lower limit of operating unit 22. When operating unit 22 moves to the lower limit, magnet 23 mounted on the lateral face of operating unit 22 moves also downward, so that magnet 23 becomes apart from magnetic detector 26 originally confronted with the center of magnet 23.

Figure 5:
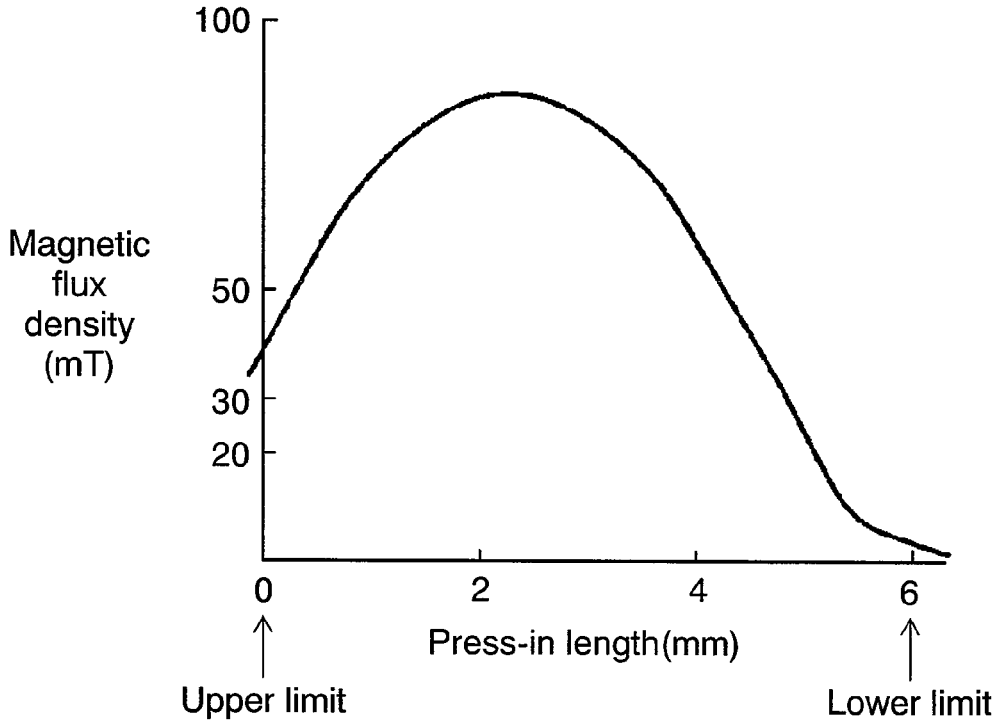
FIG. 5 shows a graph illustrating a relation between a push-stroke (press-in length) of an operating unit and a magnetic flux density from a magnet detected by a magnetic detector of the vehicle switch in accordance with the first exemplary embodiment of the present invention.

FIG. 5 shows a graph illustrating a relation between a push-stroke (press-in length) of operating unit 22 and a magnetic flux density delivered to magnetic detector 26 from magnet 23 of vehicle switch 50. When operating unit 22 stays at the lower limit position, magnetic detector 26 senses weak magnetism delivered from magnet 23.

Control circuit 28 coupled to magnetic detector 26 closes or opens switching device 27 depending on the strength of magnetism sensed by detector 26. Specifically, switching device 27 is closed at a first value of the detected magnetic flux density or more, and is opened at a second value of the detected magnetic flux density or less, which is smaller than the first value. For instance, the first value is 30 mT (millitesla), and the second value is 20 mT when the magnetic flux density on the surface of magnet 23 is 100 mT. When operating unit 22 stays at the lower limit position, switching device 27 is opened, and brake light 31 formed of a plurality of light emitting diodes (LEDs), for example, is turned off.

Then when brake pedal 51 is stepped on, arm 51A moves to the position drawn with alternate long and two short dashes lines in FIG. 3. Since arm 51A leaves operating shaft 22A and the pressing force applied to operating shaft 22A is removed, operating unit 22 moves upward due to resilient restoring force of return spring 29. Magnet 23 mounted to operating unit 22 also moves upward and approaches magnetic detector 26, which thus senses stronger magnetism delivered from magnet 23. As shown in FIG. 5, when the press-in length becomes near 4 mm, the magnetic flux density detected by control circuit 28 exceeds 30 mT, so that control circuit 28 closes switching device 27 for turning on brake light 31. As described above, control circuit 28 electrically opens and closes switching device 27 corresponding to the strength of the detected magnetic flux density.

Operating unit 22 then further moves upward, and the detected magnetic flux density becomes the strongest at the position where the center of magnet 23 confronts the center of magnetic detector 26, i.e. the press-in length is around 2 mm. Thereafter, operating unit reaches its upper limit, where stopper 23B hits the underside of cover 30 as shown in FIG. 1. At this upper limit, the detected magnetic flux density counts around 40 mT, so that brake light 31 is kept turning on.

In other words, the vertical motion of magnet 23 mounted to operating unit 22 varies the output from magnetic detector 26, and control circuit 28 processes this variation to switch switching device 27 for turning on/off brake light 31. This configuration is free from mechanical construction such as fixed contacts or movable contacts susceptible to their working place exposed to excessive dust, gas, dampness, and lubricating agent. As a result, vehicle switch 50 can perform electrical switch-on and switch-off with reliability.

Here, magnet 23 and magnetic detector 26 are so placed that magnetic detector 26 receives different strengths of magnetic flux density at the upper and lower limit position of operation unit 22. More specifically, magnet 23 mounted on operating unit 22 and magnetic detector 26 facing magnet 23 are so arranged that magnetic detector 26 receives the first value of the magnetic flux density or more at the upper limit position and receives the second value of the magnetic flux density or less at the lower limit position. The circuit constant of control circuit 28 is set so that control circuit 28 closes switching device 27 when operating unit 22 is at the upper limit position and opens switching device 27 when it is at the lower limit position. These settings allow, with reliability, turning on brake light 31 when operating unit 22 is at the upper limit position, and turning off brake light 31 when operating unit 22 is at the lower limit position, even if operating unit 22 deviates somewhat from the correct positions.

Second Exemplary Embodiment

Figure 6:
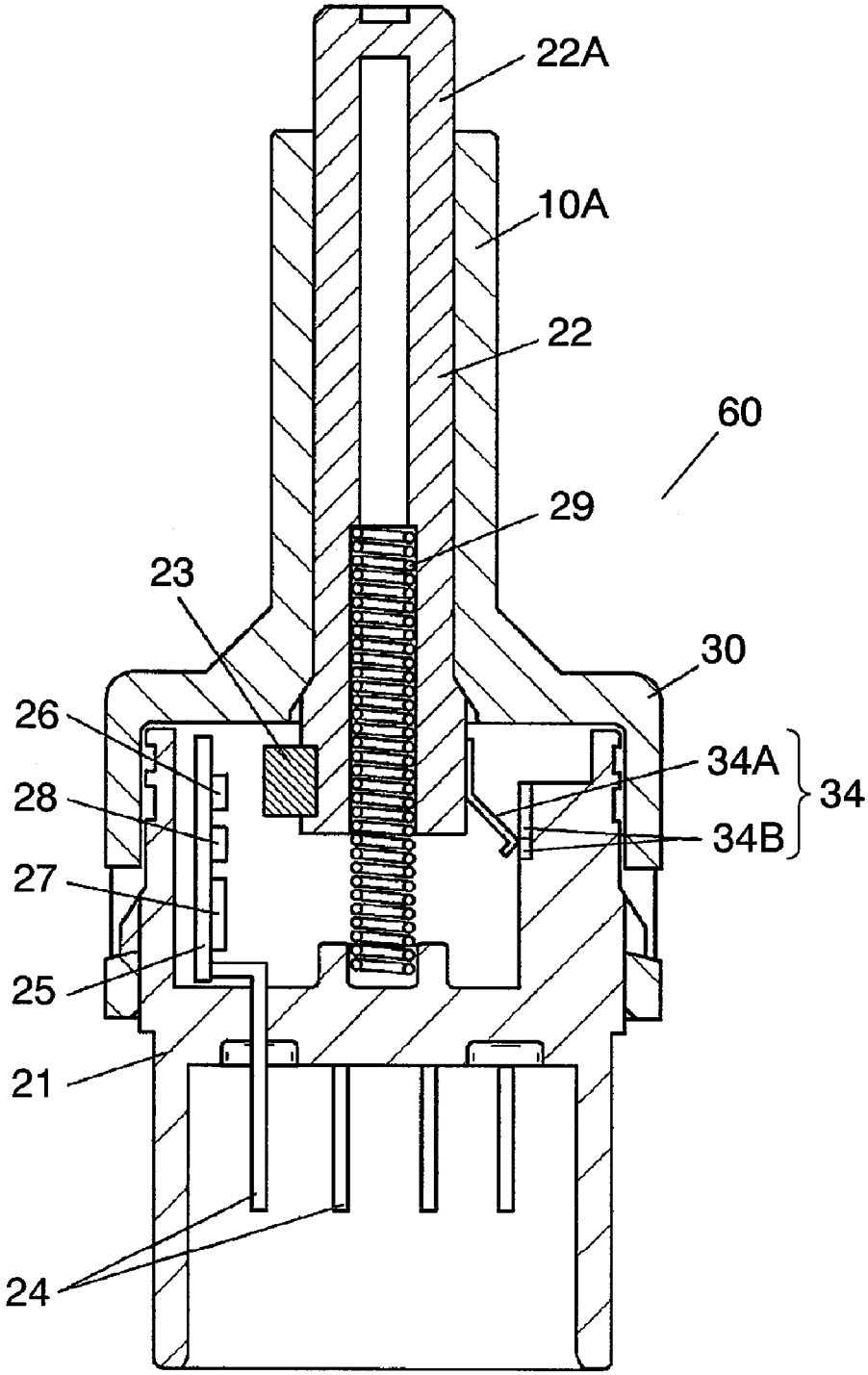
FIGS. 6 and 7 show sectional views of a vehicle switch in accordance with a second exemplary embodiment of the present invention.

FIG. 6 shows a sectional view of a vehicle switch in accordance with the second exemplary embodiment of the present invention. This vehicle switch has basically a similar structure to the structure in accordance with the first exemplary embodiment shown in FIG. 1 except that the switch has additional switch contact 34, which are formed of movable contact 34A and fixed contact 34B. Movable contact 34A made of thin metal plate such as copper alloy is fixed to the lower right side of operating unit 22 at its first end. Two of fixed contacts 34B made of, e.g. copper alloy, are placed on the right-side inner wall of housing 21. The second end of movable contact 34A is somewhat bowed and brought into contact with fixed contacts 34B, so that they are electrically connected to each other.

Figure 8:
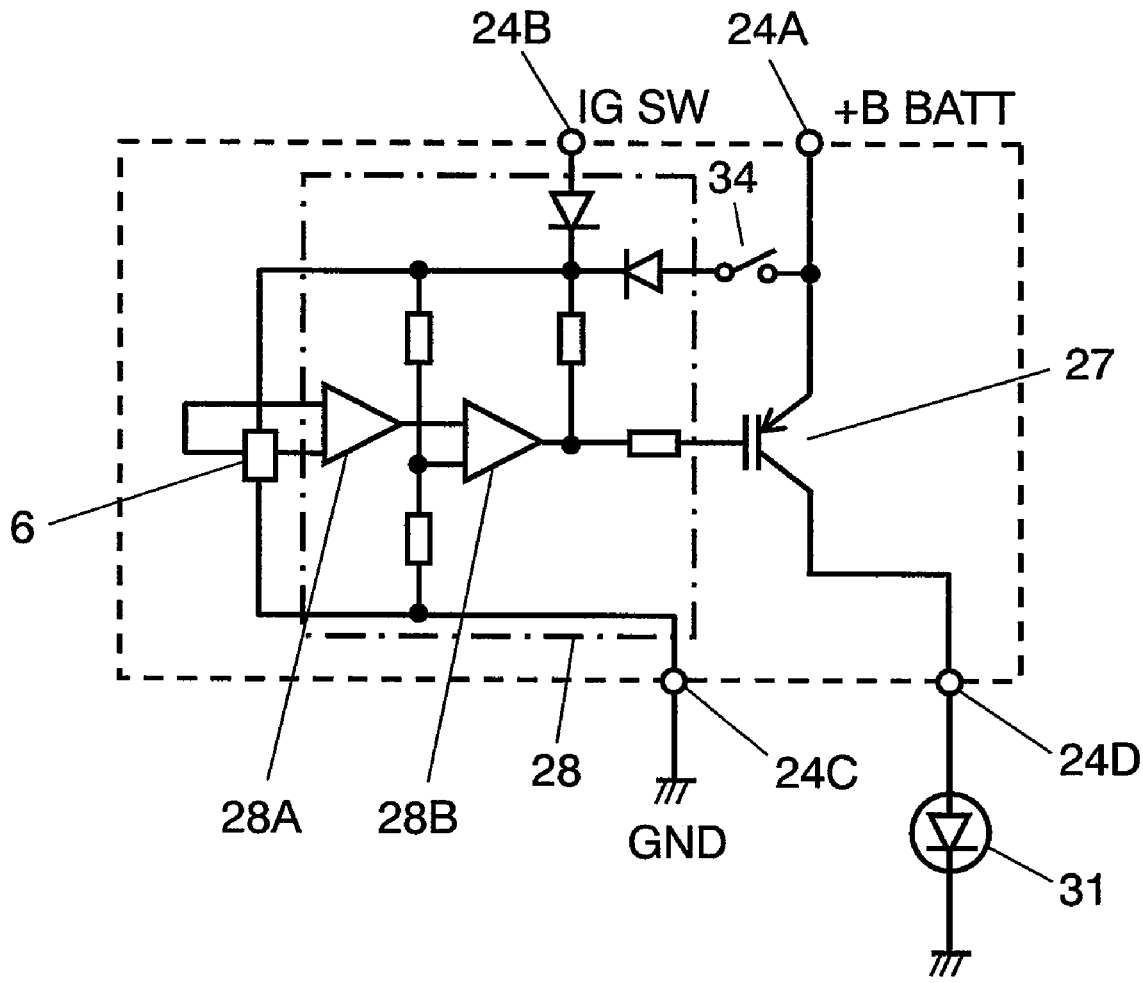
FIG. 8 shows an electrical circuit diagram including a control circuit for controlling the vehicle switch in accordance with the second exemplary embodiment of the present invention.

Switch contact 34 is coupled to a wired pattern of wiring board 25 via arms (not shown) extending from fixed contacts 34B. FIG. 8 shows the circuit diagram of the entire control section, which has many structural elements common to the one shown in FIG. 4; however, the following two points largely differ from the one: (1) switch contact 34 is coupled with control circuit 28, and (2) terminals 24 includes terminal 24A to be coupled to a battery, and terminal 24B to be coupled to an ignition switch (IGSW). In other words, switch contact 24 to be in on/off states corresponding to the vertical movement of operating unit 22 is provided between the battery (a power supply) and control circuit 28, and control circuit 28 is coupled with the ignition switch.

Vehicle switch 60 thus constructed is generally mounted in front of brake-pedal 51 in a state that operating shaft 22A is pressed by arm 51A as shown in FIG. 3. Terminals 24 protruding from the outer bottom of housing 21 are coupled to brake light 31 formed of LEDs, the ignition switch, and the battery via connector 52 and lead-wires.

Figure 7:
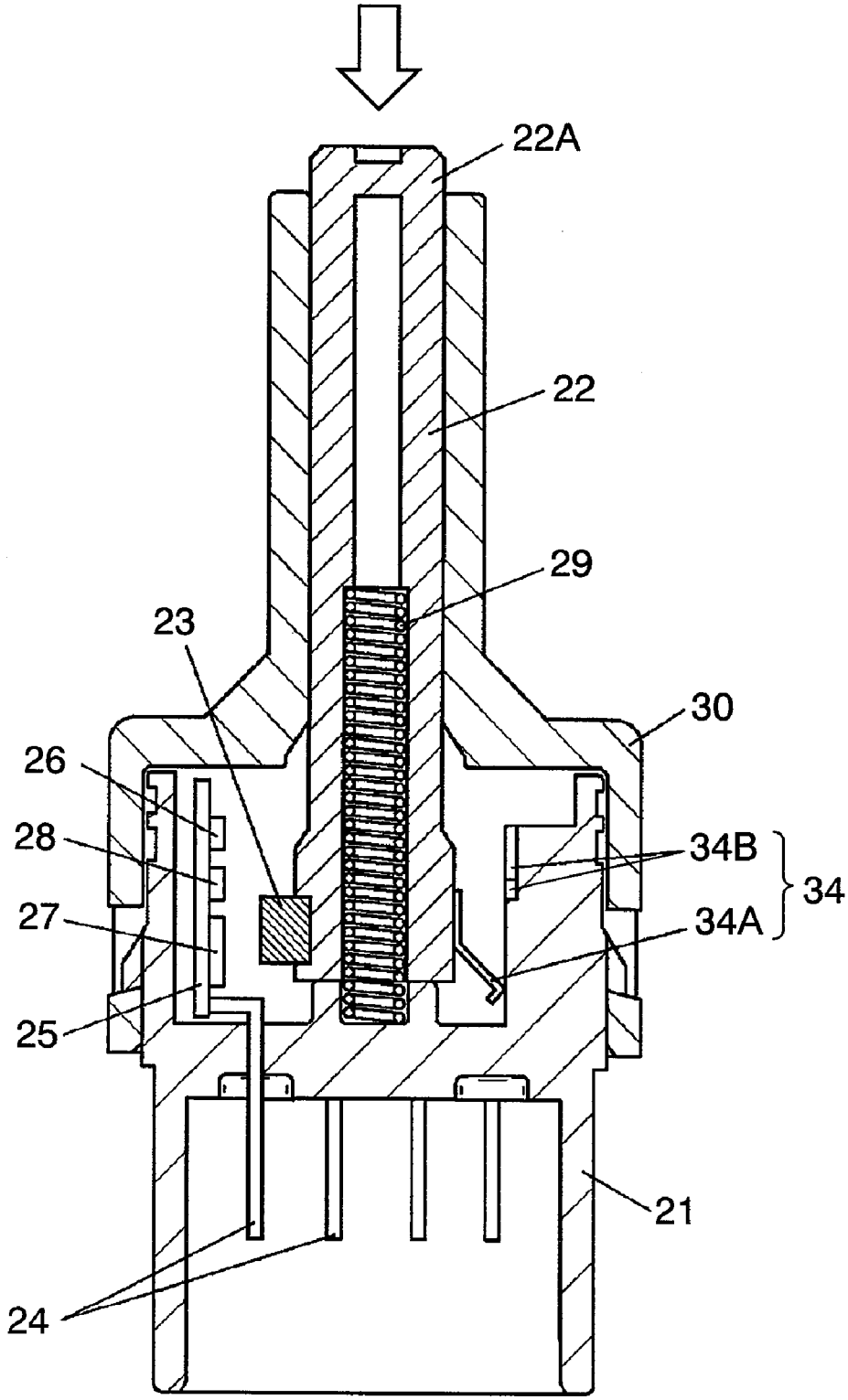

When the ignition switch is turned on for starting the engine, and while the brake pedal 51 is not stepped on, the force along the arrow mark shown in the upper section of FIG. 7 is applied to vehicle switch 60 by arm 51A of brake pedal 51. As shown in FIG. 7, operating shaft 22A is pushed downward while it compresses return spring 29. Magnet 23 mounted on the left lateral face of operating unit 22 moves also downward, so that the center of magnet 23 becomes apart from the center of magnetic detector 26. As a result, magnetic detector 26 senses weak magnetism delivered from magnet 23. Control circuit 28 coupled to magnetic detector 26 is designed to close or open switching device 27 in response to the strength of the magnetism detected by magnetic detector 26. The operation is same as in the first exemplary embodiment. To be more specific, when the detected magnetic flux density measures the second value or less, control circuit 28 opens switching device 27. Switching device 27 is thus opened when operating unit 22 is pressed, and brake light 31 is turned off.

Movable contact 34A mounted on the right lateral face of operating unit 22 also moves downward, and leaves fixed contacts 34B before it touches the right inner wall of housing 21 when operating unit 22 is pressed. Switch contact 34 thus electrically separates the battery from control circuit 28.

When brake pedal 51 is stepped on, arm 51A moves to the position drawn with alternate long and two short dashes lines shown in FIG. 3. Arm 51A thus leaves operating shaft 22A and the pressing force applied to operating shaft 22A is removed. Accordingly, operating unit 22 moves upward due to resilient restoring force of return spring 29. As shown in FIG. 6, magnet 23 mounted to the left side of operating unit 22 approaches magnetic detector 26, and magnet 23 confronts detector 26.

At the same time, movable contact 34A mounted on the right side of operating unit 22 touches fixed contacts 34B, so that switch contact 34 becomes electrically conductive. Magnetic detector 26 and control circuit 28 are powered through terminal 24B coupled to the ignition switch and terminal 24A coupled to the battery. Magnet 23 confronts magnetic detector 26, and magnetic detector 26 senses strong magnetism from magnet 23. In other words, the magnetic flux density detected by magnetic detector 26 becomes the first value or more. With respect to the detection, control circuit 28 closes switching device 27 for turning on brake light 31.

As described above, while the ignition switch is turned off and brake pedal 51 is not stepped on, vehicle switch 60 receives no electric current at all, so that the battery does not consume its power, i.e. this state is in power-saving mode.

In this state, when brake pedal 51 is stepped on, operating unit 22 moves upward due to the resilient restoring force of return spring 29, and switch contact 34 electrically couples the battery and the control circuit 28. The battery thus supplies power from terminal 24A to magnetic detector 26 and control circuit 28 via switch contact 34. At the same time, control circuit 28 closes switching device 27 based on the sensing of magnetic flux density by magnetic detector 26 confronted with magnet 23 which has moved upward, so that brake light 31 is turned on.

That is to say, when the vehicle stops and its ignition switch is turned off for stopping the engine, vehicle switch 60 receives no electric current at all, and the battery does not consume its power, namely, the vehicle falls into the power-saving mode. In this state, when brake pedal 51 is stepped on, switch contact 34 becomes conductive, and then detector 26 and circuit 28 are powered for turning on brake light 31 with reliability.

Note that switch contact 34 preferably becomes conductive before switching device 27 becomes closed from its open status due to magnetic detector 26, and switch contact 34 preferably becomes non-conductive after switching device 27 becomes closed from its closed status due to magnetic detector 26. The positional relation between magnet 23 mounted on the left lateral face of operating unit 22 and movable contact 34A mounted on the right lateral face is preferably adjusted so that switch contact 24 is operated as discussed above. To be more specific, it is preferable that a change in strength of magnetism sensed by detector 26 preferably closes switching device 27 after switch contact 34 becomes conductive. It is also preferable that switch contact 34 is cut off after a change in strength of magnetism opens switching device 27. This mechanism allows supplying power to magnetic detector 26 and control circuit 28 via switch contact 34 at all times while switching device 27 is closed, so that stable operation can be expected.

Vehicle switch 50 in the first exemplary embodiment discussed previously allows the battery to supply power to detector 26 and circuit 28 although the ignition switch is cut off and the engine is halted, so that brake light 31 can be turned on when brake pedal 51 is stepped on. However, this structure requires an electric current around 3 mA to run at all times, even when the engine is halted. In contrast, the vehicle switch of the present embodiment can save more power than the vehicle switch of the first exemplary embodiment.

In the foregoing description, switch contact 34 is demonstrated so that movable contact 34A is fixed on the right lateral face of operating unit 22, and elastically urged against fixed contacts 34B. However, the present invention is not limited to this type of switch contacts, and various types of switch contacts can be used. For instance, a lead-switch, which is electrically switched on/off by the magnetism delivered from magnet 23 mounted on the left lateral face of operating unit 22, can be used as switch contact 24, or switch contacts using piezoelectric member, which is electrically switched on/off by a push of operating unit 22, can be also used as switch contact 24.

Third Exemplary Embodiment

Figure 9:
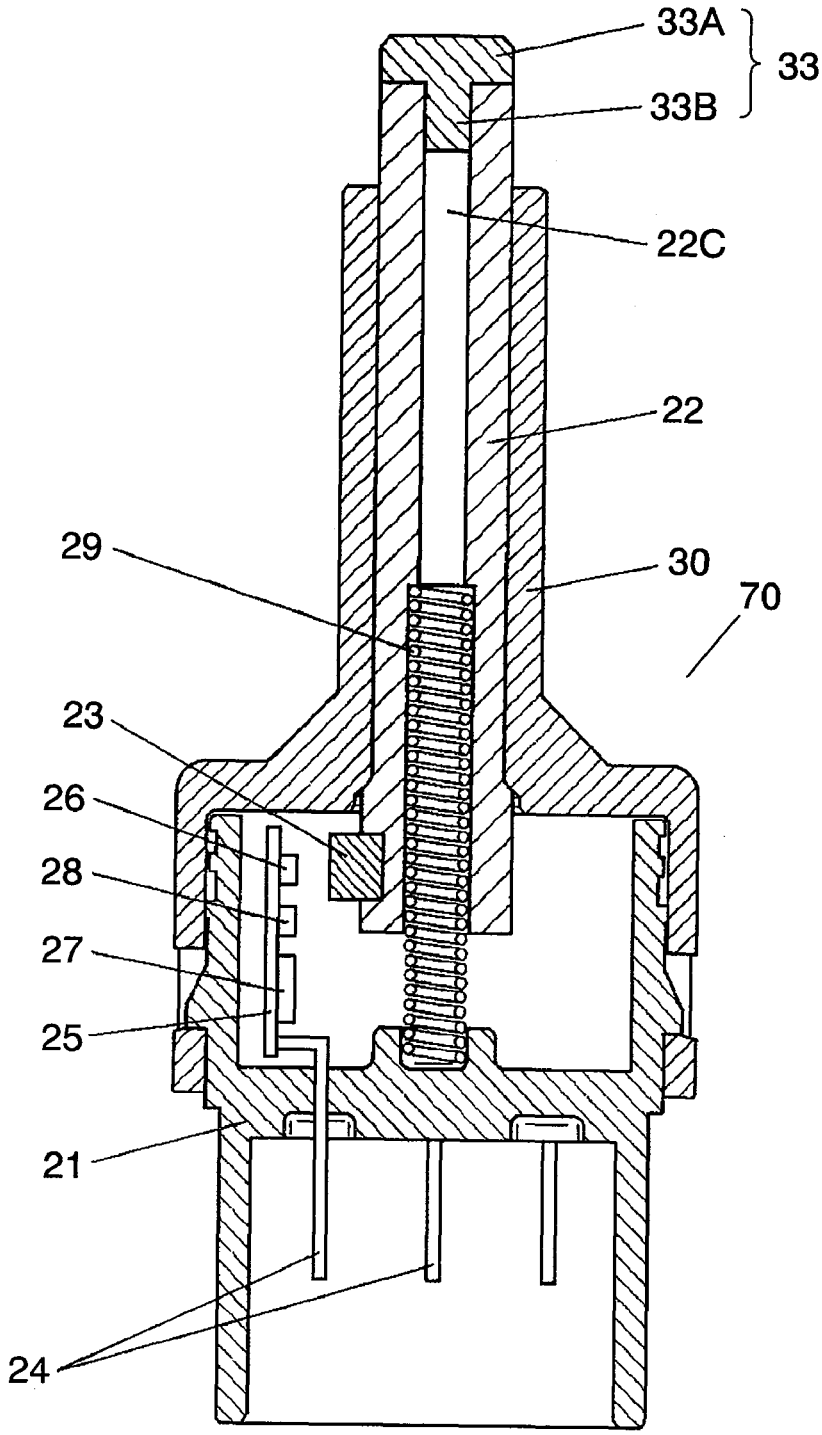
FIG. 9 shows a sectional view of a vehicle switch in accordance with a third exemplary embodiment of the present invention.

FIG. 9 shows a sectional view of a vehicle switch in accordance with the third exemplary embodiment of the present invention. This vehicle switch has basically a similar structure to the structure in accordance with the first exemplary embodiment and shown in FIG. 1 except that the switch additionally includes adjuster 33 made from insulating resin such as polybutyleneterephthalate (PBT) or polyurethane. Adjuster 33 has a sectional view shaped like letter "T" and is provided on the tip of operating unit 22. Namely, operating unit 22 has adjuster 33 for adjusting the whole length of operating unit 22 at its end protruding from cover 30 which is a part of the external packaging.

More specifically, adjuster 33 is provided at the tip of operating unit 22 protruding upwardly from the cylindrical portion at the center on the top face of cover 30. Adjuster 33 is provided to adjust the position of upper end of operating unit 22, and has pushing section 33A shaped like a disk and fitting section 33B protruding from the underside of pushing section 33A. Fitting section 33B is inserted into hollow section 22C from the upper end of operating unit 22, and then fixed there by welding, for example.

Figure 10A:
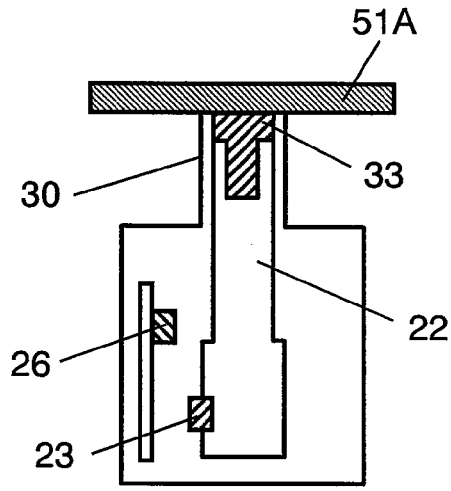
FIGS. 10A, 10B, and 10C schematically illustrate pushing motion of an operating unit of the vehicle switch in accordance with the third exemplary embodiment.
Figure 10B:
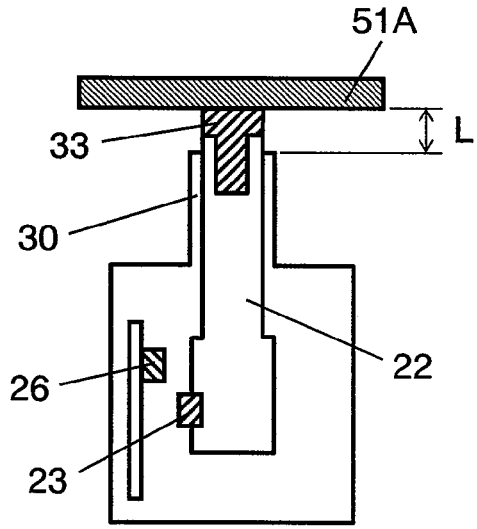
Figure 10C:
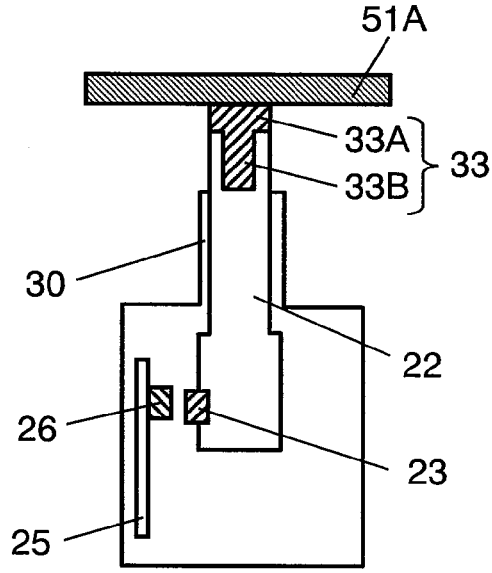

FIGS. 10A, 10B, and 10C schematically illustrate pushing motion of operating unit 22 of vehicle switch 70 in accordance with the third exemplary embodiment. These drawings show schematic sectional views. FIG. 10A illustrates the state where operating unit 22 is completely pushed into cover 30. Magnet 23 and magnetic detector 26 are apart from each other, so that a circuit for turning on a brake light is opened and the light is turned off. To the contrary, FIG. 10C illustrates the state where operating unit 22 protrudes from cover 30. Magnet 23 is close to detector 26, so that the circuit for turning on the brake light is closed and the light is turned on. FIG. 10B illustrates an intermediate state between the foregoing two states.

Distance "L" between the edge of cover 30 and the portion where arm 51A touches operating unit 22 takes a certain value, which indicates a threshold position between open and close of the circuit. The vehicle switch should be made up such that the distance "L" takes the same value in any one of the vehicle switches. In manufacturing the vehicle switches, however, dispersion is found in the positions of magnetic detector 26 and magnet 23, and also in the strength of magnetic field. These factors disperse the value of distance "L", thereby dispersing the timing between press-in by brake pedal 51 and turn-on of brake light 31.

Figure 11A:
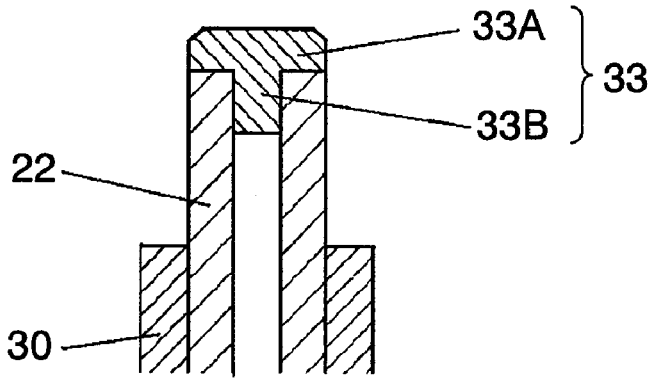
FIGS. 11A, 11B, and 11C show sectional views of an adjustor of the vehicle switch in accordance with the third exemplary embodiment of the present invention.
Figure 11B:
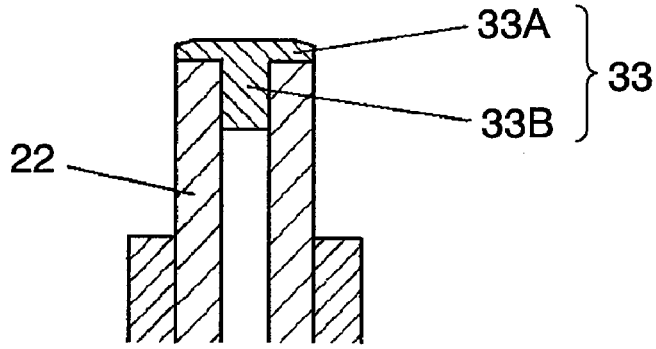

A method of reducing this dispersion is demonstrated hereinafter with reference to FIGS. 11A, 11B and 11C which show sectional views illustrating the upper end of the vehicle switch. For instance, when a positional deviation is as large as 0.5 mm, large adjuster 33, whose pushing section 33A is as high as 0.5 mm, is mounted at the upper end of operating unit 22 as shown in FIG. 11A. When the positional deviation is as small as 0.1 mm, small adjuster 33, whose pushing section 33A is as low as 0.1 mm, is mounted at the upper end of operating unit 22 as shown in FIG. 11B. Adjuster 33 in each case is fixed to the upper end of operating unit 22 by welding or adhesive. In other words, the height of adjuster 33 is adjusted for switching device 27 to opens or closes at a certain press-in length of operating unit 22, and such adjuster 33 is fixed onto the upper end of operating unit 22, thereby adjusting the position of the upper end where brake pedal 51 touches, so that the positional relation between magnet 23 and magnetic detector 26 about the timing of open/close of switching device 27 becomes constant and is corrected to have no dispersion. The vehicle switch, having distance "L" which is kept constant at a certain value exactly, can be thus manufactured with ease.

As discussed above in the present embodiment, adjuster 33 is placed on operating unit 22 at the upper end where brake pedal 11 touches. Adjuster 33 is provided for adjusting the position of the upper end of operating unit 22. In assembling the vehicle switch, positional deviation may occur in placing magnetic detector 26 and so forth, so that dispersion may occur in press-in length of operating unit 22 and in timing of open/close of switching device 27. In this case, the upper end position of operating unit 22 can be adjusted with the adjuster 33, thereby compensating the timing of open/close of switching device 27 with ease. The vehicle switch can be thus manufactured with ease and at an inexpensive cost.

In the foregoing description as FIGS. 11A and 11B illustrate, two types of adjuster 33, namely each pushing section thereof has different height each other, are used for adjusting the position of the upper end of operating unit 22. However, use of various types of adjuster 33 fixed at the upper end of operating unit 22, namely each pushing section thereof has different height, allows more elaborate adjustment to the position of the upper end of operating unit 22.

Figure 11C:
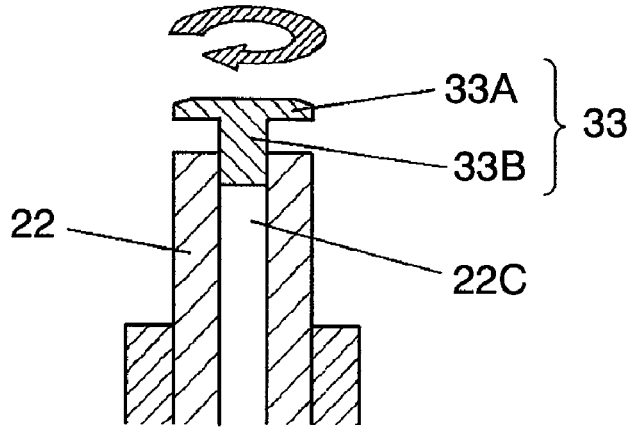

In addition as shown in FIG. 11C, the outer wall of mounting section 33B, i.e. the section lower than pushing section 33A, is provided with a thread (not shown) for a screw, and the inner wall of hollow section 22C is provided with a counterpart thread (not shown) for the screw, so that adjuster 33 can be screwed in or out for adjusting its height, then adjuster 33 is fixed by welding or adhesive. This structure allows adjusting the upper end of operating unit 22 at various positions with one single adjuster 33.

Fourth Exemplary Embodiment

Figure 12:
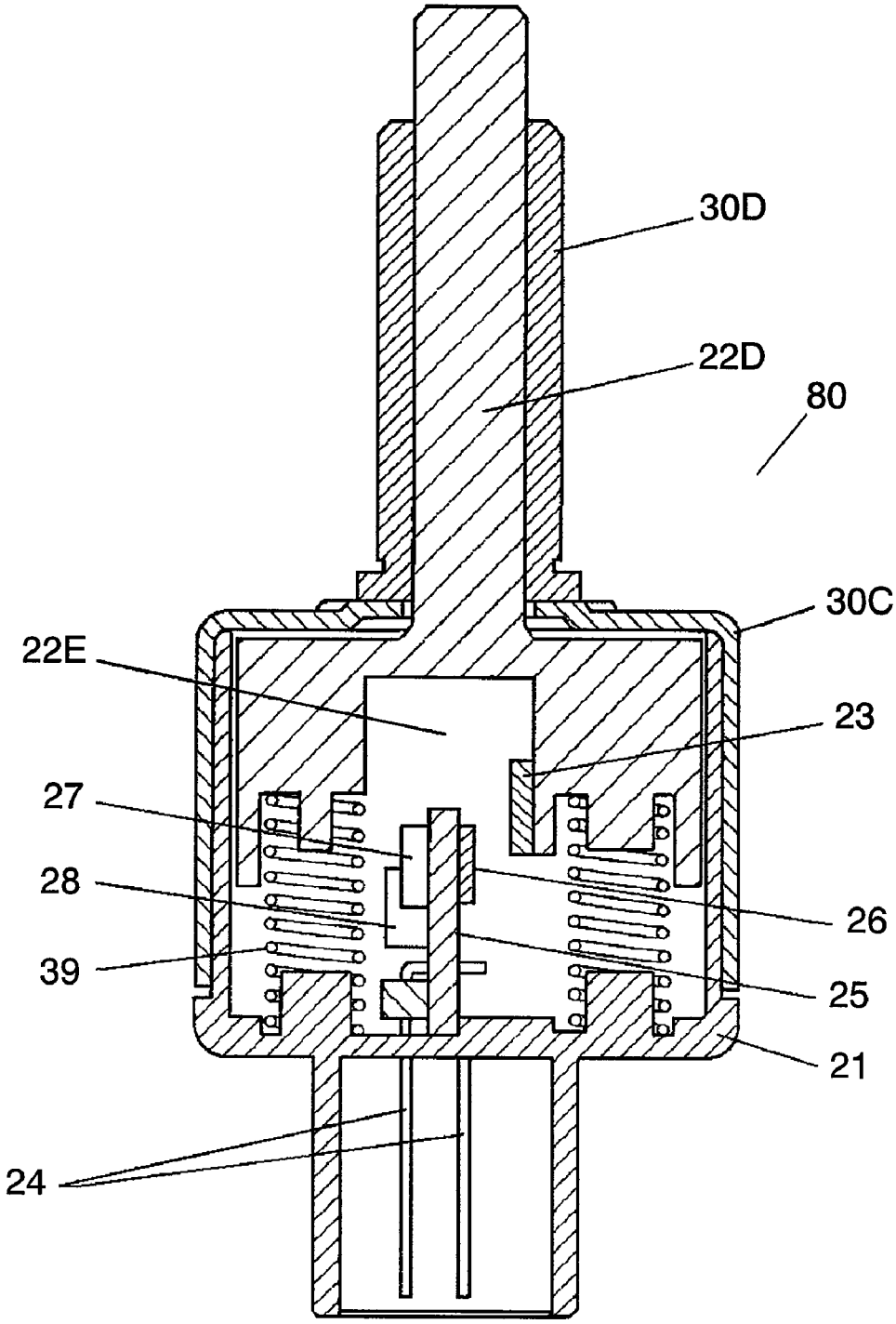
FIG. 12 shows a sectional view of a vehicle switch in accordance with a fourth exemplary embodiment of the present invention.
Figure 13:
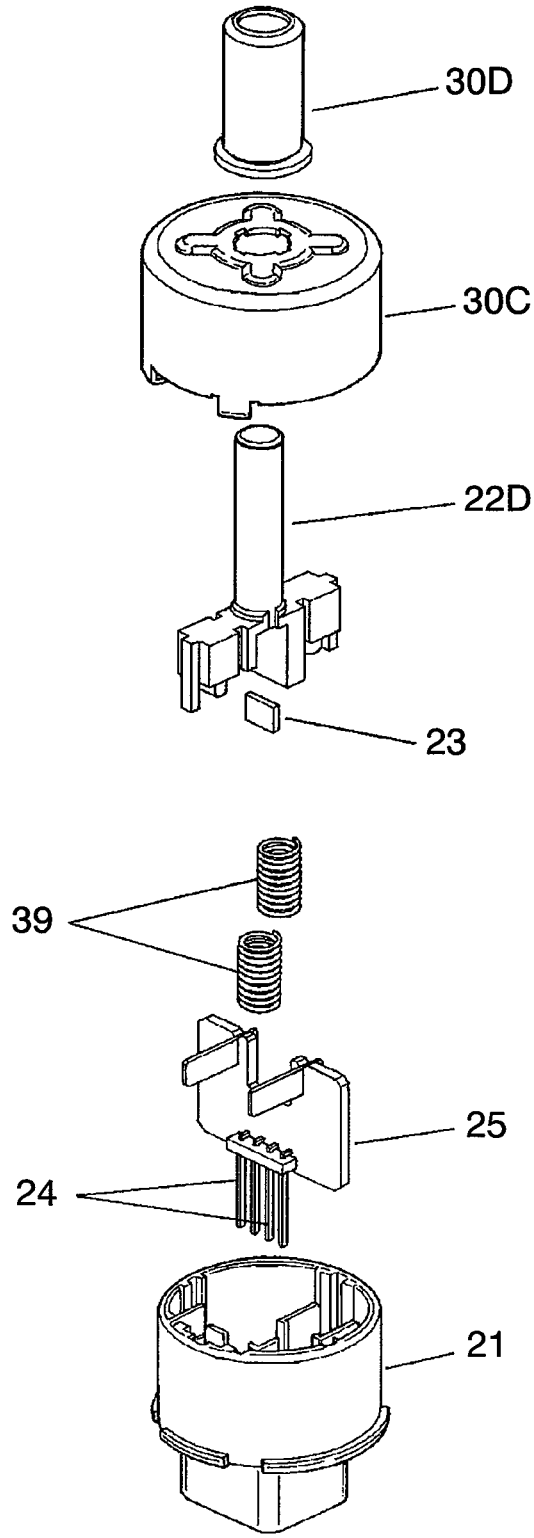
FIG. 13 shows an exploded perspective view of the vehicle switch in accordance with the fourth exemplary embodiment of the present invention.

FIG. 12 shows a sectional view of a vehicle switch in accordance with the fourth exemplary embodiment of the present invention, and FIG. 12 shows an exploded perspective view thereof. The external packaging of vehicle switch 80 is formed of housing 21, cover 30C and cylinder 30D. Cover 30C is made of metal or insulating resin and covers an opening at the top of housing 21. Cylinder 30D is fixed at the center on the top face of housing 21.

Substantially columnar operating unit 22D made of insulating resin is accommodated in the external packaging composed of housing 21, cover 30C and cylinder 30D such that it can move upward and downward. Operating unit 22D is provided with concave portion 22E in its lower-middle section, and magnet 23 is mounted on the inner wall around concave portion 22E. Terminals 24 made of copper alloy or the like are coupled to wiring board 25 on which a plurality of wired patterns (not shown) is formed, and the lower ends of terminals 24 protrude downward from the outer bottom of housing 21.

Wiring board 25 is placed at approx. center of housing 21, and magnetic detector 26 and switching device 27 are mounted on wiring board 25. Wiring board 25 further includes control circuit 28 formed. Two return springs 39 are placed on both sides of wiring board 25, and somewhat compressed between the underside of operating unit 22D and the inner bottom face of housing 21, so that springs 39 urge operating unit 22D upward. The upper end of operating unit 22D protrudes upward from cylinder 30D.

Vehicle switch 80 discussed above is used as shown in FIG. 3, and the specific usage is described as same as in the embodiments previously discussed.

When brake pedal 51 is not stepped on, operating unit 22D is pushed downward with return springs 39 on both sides compressed, so that magnet 23 mounted to the lower middle section of operating unit 22D also moves downward. The center of magnet 23 is thus considerably apart from the center of magnetic detector 26. Accordingly, magnetic detector 26 senses weak magnetic flux density delivered from magnet 23. Control circuit 28 coupled to detector 26 is designed to close or open switching device 27 in response to the strength of the magnetic flux density sensed by detector 26. The operation is same as in the first exemplary embodiment. To be more specific, when the magnetic flux density measures the second value or less, control circuit 28 opens switching device 27. Switching device 27 is thus opened when operating unit 22D is pressed, and brake light 31 is turned off.

When brake pedal 51 shown in FIG. 3 is stepped on, arm 51A moves leftward as shown in the drawing, and operating unit 22D moves upward in FIG. 12 due to the resilient restoring force of return springs 39. When operating unit 22D arrives at a given position, detector 26 senses stronger magnetic flux density over the first value, so that control circuit 28 closes switching device 27 for turning on brake light 31.

When brake pedal 51 is further stepped on deeply, arm 51A leaves the upper end of operating unit 22D and the pushing force is removed, so that operating unit 22D further moves upward due to the resilient restoring force of return springs 39. In accordance with the movement, magnet 23 mounted to operating unit 22D moves also upward. Magnet 23 moves thus closely to magnetic detector 26 and the magnetic flux density detected by magnetic detector 26 becomes strong enough for brake light 31 to be kept turning on.

In this configuration, magnet 23 is positioned nearly around the centerline of operating unit 22D, and magnetic detector 26 is also positioned nearly at the center of housing 21 and nearly around the centerline of operating unit 22D so as to face magnet 23. At this position, magnet 23 and detector 26 are hardly subject to external magnetism delivered from the outside of vehicle switch 80, so that they invite few errors in its detection for magnetism from magnet 23.

Since magnet 23 is mounted at lower-middle section of operating unit 22D, even if operating unit 22D slants or shakes during its vertical motion, magnet 23 deviates from its position less than the case where it is mounted on the lateral face of operating unit 22D. As a result, errors in an open/close timing of switching device 27 are suppressed, so that vehicle switch 80 can operate with reliability. Two return springs 39 is employed in FIG. 12, however, it is possible to use a return spring whose diameter is enough large to insert wiring board 25 in the inside thereof instead of return springs 39.

Figure 14:
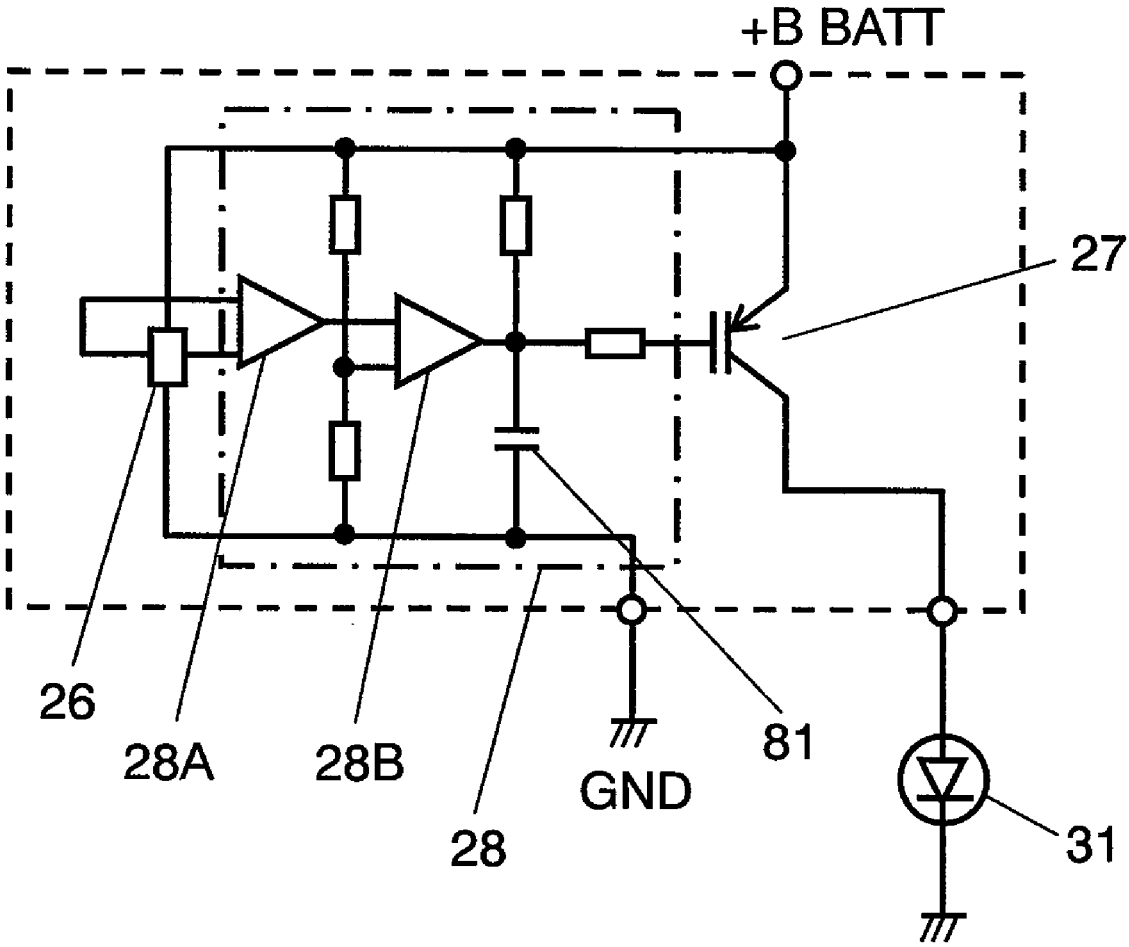
FIG. 14 shows an electrical circuit diagram including a control circuit for controlling the vehicle switch in accordance with the fourth exemplary embodiment of the present invention.
Figure 15:
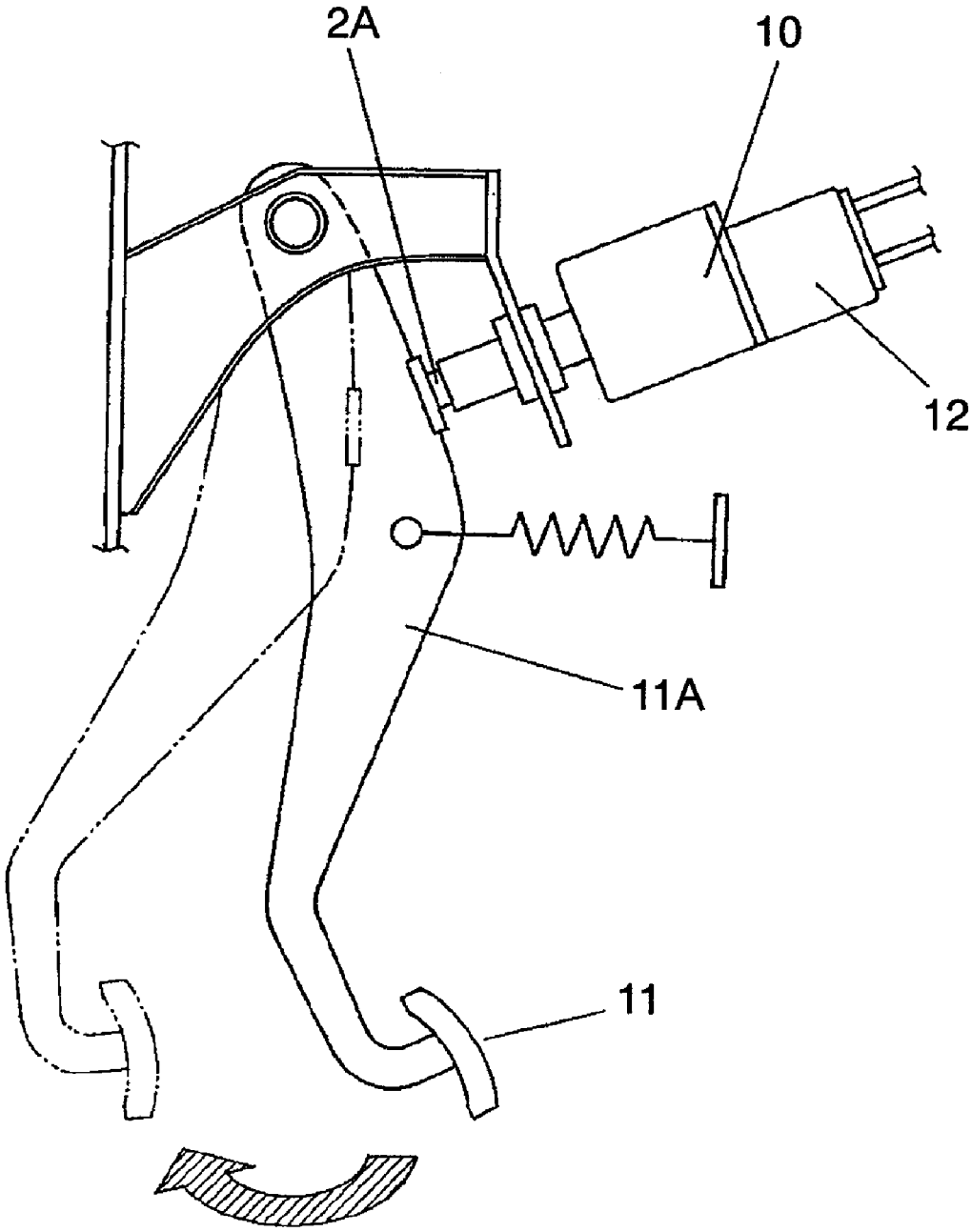
FIG. 15 PRIOR ART
FIG. 15 shows a lateral view of a conventional brake to be used in a vehicle.
Figure 16:
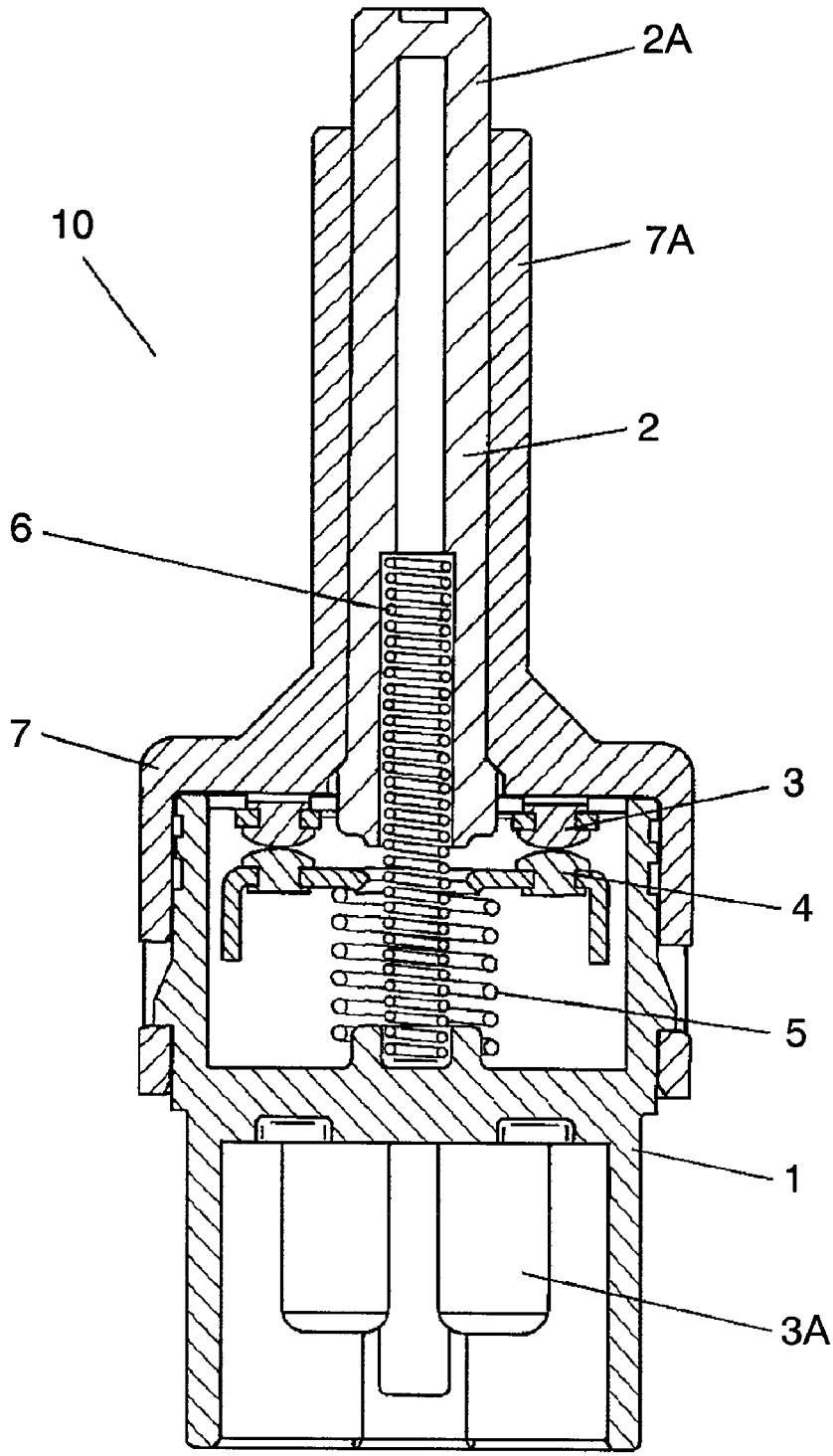
FIG. 16 PRIOR ART
FIG. 16 shows a sectional view of a conventional vehicle switch.

FIG. 14 shows an electrical circuit diagram including magnetic detector 26, switching device 27 and control circuit 28 of vehicle switch 80.

A conventional vehicle switch encounters an inrush current when it is turned on, and an arc discharge between the just-opened switch contacts when it is turned off. The switch contacts are thus vulnerable to damages. In addition, since the switch contacts have undergone the electric current flowing in the same direction at all times, so that the contacts are subject to erosion problem. On top of that, use of LEDs as brake light 31 will cause breaking down, if the inrush current exceeds the maximum current ensured by the LEDs. This problem also tells that use of brake light 31 employing filament will cause a greater inrush current, so that the electric current path generates heat, which needs, as a matter of course, some countermeasures.

In contrast, as shown in FIG. 14, when a capacitor 81 is provided between the output terminal of voltage detector 28B and the ground (GND), it can gradually turn on switching device 27 and eliminate the inrush current. Conventional switch cannot eliminate the inrush current in such a way. In addition, Hysteresis can be provided to the timing of on/off of switching device 27 by control circuit 28 so that chattering can be advantageously prevented. This circuit configuration can be applied to the first to third exemplary embodiments.

In the foregoing description of the first to fourth exemplary embodiments, magnetic detector 26 is placed at an upper place, so that when the detected magnetic flux density is strong because operating unit 22 is at its upper limit position, control circuit 28 closes switching device 27, and when the detected magnetic flux density is weak because operating unit 22 is at its lower limit position, control circuit 28 opens switching unit 27. However, the elements can be arranged in a reversal order to what is discussed above. Namely, magnetic detector 26 may be placed at the lower position, i.e. nearer to the bottom of the vehicle switch, so that the detected magnetic flux density is weak when operating unit 22 is at its upper limit position, and the detected magnetic flux density is strong when operating unit 22 is at its lower limit position. Also in this arrangement, control circuit 28 opens or closes switching device 27 in response to magnetic strength. The present invention is also practicable with the structure described above.

The foregoing descriptions in the first to fourth exemplary embodiments discuss about the push-type vehicle switches 50, 60, 70 and 80 operated with a brake pedal of a vehicle; however, the present invention is applicable to other switches to be used for other functions, e.g. open/close a door, or to other switches operated by another method, such as to swing operating unit 22 or slide operating unit 22 parallel.

What is claimed is:

1. A vehicle switch to be used in a vehicle, comprising:

an external packaging;

an operating unit accommodated in the external packaging so as to be movable linearly;

a spring provided to urge the operating unit in a direction away from an inner bottom of the external packaging;

a magnet mounted to the operating unit;

a magnetic detector fixed with a distance from the magnet;

a control circuit coupled to the magnetic detector; and a switching device to be electrically opened and closed by the control circuit, wherein the magnet and the magnetic detector are placed such that the magnetic detector senses a range of values of magnetic flux density from the magnet depending on an upper limit position and a lower limit position of the operating unit, and the control circuit electrically closes the switching device when the sensed value of the magnetic flux density is greater than or equal to a predetermined magnetic flux density value and electrically opens the switching device when the sensed value of the magnetic flux density is less than the predetermined magnetic flux density value.

2. The vehicle switch according to claim 1 further comprising a switch contact being opened and closed electrically in response to a linear movement of the operation unit.

3. The vehicle switch according to claim 2, wherein the switch contact, the magnet, and the magnetic detector are so arranged so that the switch contact is conductive before the switching device is switched over from an open state to a closed state, and the switch contact is cut off after the switching device is switched over from the closed state to the open state.

4. The vehicle switch according to claim 1, the operating unit has an adjuster to adjust a length of the operating unit at an upper end of the operating unit, the upper end protruding from the external packaging.

5. The vehicle switch according to claim 1, wherein the magnet is mounted to a lower-middle section of the operating unit, and the magnetic detector is placed at a center of the external packaging so as to confront the magnet.

6. The vehicle switch according to claim 1, wherein the predetermined magnetic flux density value is about 30 mT.

* * * * *